US005228680A

United States Patent [19]

Sugiura

[11] Patent Number: 5,228,680

[45] Date of Patent: Jul. 20, 1993

[54] SHEET FEED DEVICE CAPABLE OF FACILITATING SHEET REMOVAL FROM SHEET FEED PATH

[75] Inventor: Toshiaki Sugiura, Hekinan, Japan

[73] Assignee: Brother Kogyo Kabushiki Kaisha, Nagoya, Japan

[21] Appl. No.: 889,799

[22] Filed: May 29, 1992

[30] Foreign Application Priority Data

Jun. 14, 1991 [JP] Japan ..... 3-143253

[51] Int. Cl.[5] ..... B65H 7/02

[52] U.S. Cl. ..... 271/259; 271/265

[58] Field of Search ..... 271/259, 265

[56] References Cited

U.S. PATENT DOCUMENTS 3,626,956 12/1971 Sauder ..... 271/259

FOREIGN PATENT DOCUMENTS 0303276 2/1989 European Pat. Off. ..... 271/265
0318838 6/1989 European Pat. Off. .
0058324 5/1977 Japan ..... 271/259
55-026162 2/1980 Japan .
56-137367 10/1981 Japan .
60-040362 3/1985 Japan .
0074848 4/1988 Japan ..... 271/259
0272735 11/1988 Japan ..... 271/259
1-145955 6/1989 Japan .

*Primary Examiner*—H. Grant Skaggs
*Attorney, Agent, or Firm*—Oliff & Berridge

[57] ABSTRACT

A sheet feed arrangement having an upstream first and downstream second rollers for defining a part of a sheet feed path therebetween. A first sheet detector is disposed upstream of the first roller and a second sheet detector is disposed downstream of the second roller. These detectors transmit sheet detection signals when the sheet passes therealong. The detection signals are transmittable to a control unit. The control unit is connected to a first roller drive motor and stops rotation thereof if the sheet detection by the first detector is finished whereas a leading end of the sheet has not yet been detected by the second detector. If desired, the first roller is reversely rotated to discharge the sheet toward the upstream or sheet inlet side.

9 Claims, 5 Drawing Sheets

SHEET FEED DEVICE CAPABLE OF FACILITATING SHEET REMOVAL FROM SHEET FEED PATH

BACKGROUND OF THE INVENTION

The present invention relates to a sheet feed device for use in an image recording apparatus, and more particularly, to such a device for feeding each one of the cut sheets through a manual sheet feed operation.

In a conventional image recording apparatus such as a copying machine and a printer, sheet members such as image transfer sheets and image recording sheets can be supplied to an image forming section through a sheet feed path by an automatic sheet feed means, if large numbers of the sheets having standardized size are used. On the other hand, a sheet having a size which is not frequently used for the image recordation may be supplied manually by an operator one by one through a manual sheet feed means.

In the image recording apparatus, in order to detect a sheet jamming where the sheet is not regularly transferred during feeding due to clogging, a sheet detector is disposed at the sheet feed path. With this system, judgment of sheet jamming is made if the sheet is not detected by the sheet detector after an elapse of a predetermined period counting from a start of the sheet feed operation, and such jamming is externally displayed.

In such conventional image recording apparatus, if the sheet jamming occurs, the jamming sheet must be removed. However, if a sheet whose small length is insufficient for sheet feeding is fed through the manual sheet feed means, the sheet jamming is detected after such small length sheet is completely supplied into the sheet feed path. Therefore, it would be impossible to remove the sheet from a side of the manual sheet feed means.

To avoid this, the image recording apparatus must have a structure capable of temporarily providing an open state of the sheet feed path so as to remove the jamming sheet at the sheet feed path. Therefore, the resultant apparatus has a complex construction, and the operator is obliged to carry out such troublesome sheet removing work which thus lowers operability. Further, even if the sheet has a sufficient length for the sheet feeding, such sheet removing work may be required if clogging occurs due to any reasons.

SUMMARY OF THE INVENTION

The present invention is achieved in an attempt to overcome the above described drawbacks, and it is an object of the present invention to provide a sheet feed device capable of facilitating the sheet removing work and providing a simple construction at low cost by detecting the sheet jamming at a timing prior to complete feeding of the sheet into the sheet feed path.

In order to attain this object, the present invention provides a sheet feed device for feeding a sheet along a sheet feed path, the sheet having a leading edge and a trailing edge, the sheet feed device comprising first and second rollers, first and second detectors and drive control means. The first roller is disposed at an upstream portion of the sheet feed path relative to a sheet feed direction for feeding a sheet, the first roller being rotatable in one direction for feeding the sheet in the sheet feed direction. The second roller is disposed downstream of the first roller for feeding the sheet fed by the first roller toward an intended section. The first detector is disposed upstream of the first roller for detecting the sheet, the first detector generating a first detection signal when the sheet is moved therealong, a distance being provided between the first detector and the first roller. The second detector is disposed downstream of the second roller for detecting the sheet, a second detector generating a second detection signal when the sheet is moved therealong. The drive control means is adapted for stopping rotation of the first roller, if the second detector does not detect the leading edge of the sheet even if detection of the trailing edge by the first detector has been ended.

In the sheet feed device thus constructed in the present invention, the first and the second rollers are rotated for feeding the sheet into the sheet feed path. However, the sheet feed operation is temporarily stopped or the sheet is reversally fed, if the trailing end of the sheet has just moved past the first sheet detector while the leading end of the sheet has not yet been detected by the second sheet detector. In this case, the sheet jamming is to be judged, so that the drive control means stops rotation of the first roller or reversely rotates the first roller.

BRIEF DESCRIPTION OF THE DRAWINGS

In the drawings:

FIG. 4(*b*) is a schematic side view showing another sheet feed mode in the manual sheet supply;

DETAILED DESCRIPTION OF THE PREFERRED EMBODIMENTS

A sheet feed device according to one embodiment of the present invention will next be described with reference to drawings.

Figure 1:
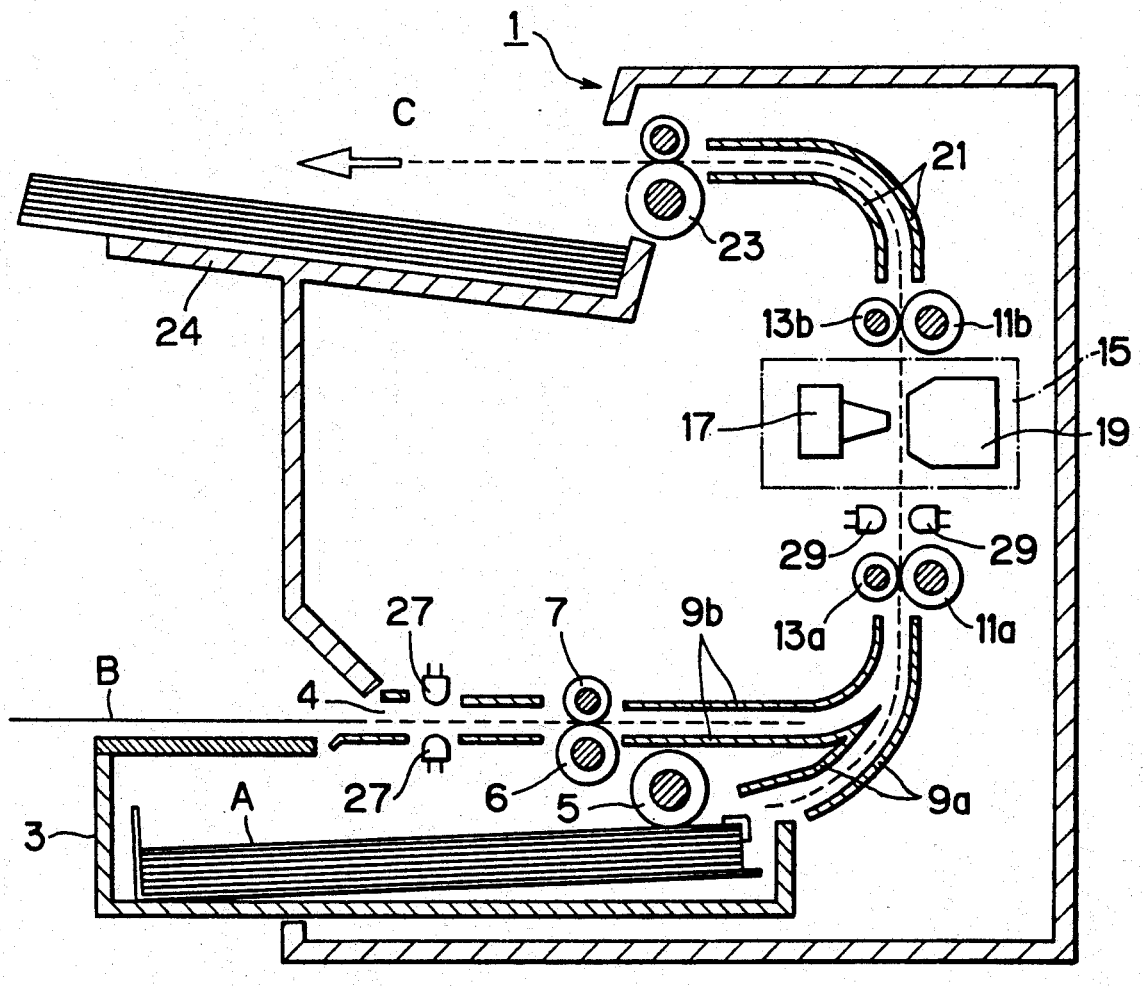
FIG. 1 is a schematic cross-sectional view showing a printer according to one embodiment of the present invention.

FIG. 1 shows a printer 1 in which the present invention is applied. As shown in FIG. 1, at a lower portion of a printer 1, a sheet cassette 3 is detachably provided for storing therein a sheet stack of a plurality of ordinarily used standardized A4 size sheets. An automatic sheet feed roller 5 is disposed at a position above an assembling position of the sheet cassette 3. The automatic sheet feed roller 5 is adapted to be contact with an uppermost sheet A in the sheet cassette 3 assembled in the printer 1, and is driven by an automatic sheet feed motor 43 (described later in connection with FIG. 2) in order to separate each one of the sheets A from the sheet stack and to supply the sheet into a printing section 15 disposed at a center portion of the printer 1. To this effect, a guide plate 9*a* is disposed immediately downstream of the sheet cassette 3 with respect to a sheet feed direction for guiding travel of the sheet A toward the printing section 15.

On the other hand, a manual sheet insertion slot 4 is formed at a position immediately above the sheet cassette 3. A sheet B whose size is different from that of the sheet A can be manually inserted one by one into the printer 1 through the insertion slot 4 by an operator. At a position above the sheet cassette 3, a manual feed roller 6 is disposed which is connected to a manual sheet feed motor 45 (see FIG. 2, and described later). Further, a rotatable pinch roller 7 is in rolling contact with the manual feed roller 6 at a predetermined pressure. Thus, the sheet B is nipped between the manual feed roller 6 and the pinch roller 7, and is fed by the rotation of these rollers by virtue of the manual sheet feed motor 45 toward the printing section 15.

The manual sheet insertion slot 4 is defined by a lower edge of a printer frame and an upper surface of the sheet cassette 3. If the sheet cassette 3 is detached from the printer frame, a large open space can be provided for facilitating access to the manual feed roller 6 and the pinch roller 7.

At an upstream side of the manual feed roller 6, a first sheet detector 27 is provided for detecting the sheet B manually inserted through the insertion slot 4. The first detector 27 is constituted by a conventional photosensor. Further, a guide plate **9*b* is disposed at downstream side of the manual feed roller 6 for feeding the sheet B fed into the printer 1 toward the printing section 15. In this connection, the guide plates 9*a* and 9*b* are joined together at the upstream side of the printing section 15. The guide plate 9*b*** serves as a sheet feed path.

At immediately upstream side of the printing section 15, an upstream feed roller **11*a* is provided, and at immediately downstream side of the printing section 15, a downstream feed roller 11*b* is provided. The pair of upstream and downstream feed rollers 11*a* and 11*b* are drivingly rotatable by a sheet feed motor 47 (see FIG. 2, described later). Further, an upstream pinch roller 13*a* and a downstream pinch roller 13*b* are rotatably contacted at a predetermined pressure with the respective upstream and downstream feed rollers 11*a* and 11*b*. Thus, the sheet A or B is nipped between the upstream pinch roller 13*a* and the upstream feed roller 11*a* and between the downstream pinch roller 13*b* and the downstream feed roller 11*b***, and is fed by rotation of these rollers.

In the printing section 15, a print head 17 is provided for printing images such as characters and marks on the sheet, and a platen 19 is provided in confronting relation to the print head 17 for supporting the sheet. Further, a head drive means (not shown) is provided for driving the print head 17 so as to print the images in accordance with print data inputted through an external device such as a personal computer. Incidentally, a structure of the head drive means at the printing section 15 and control routine thereof are conventional, and therefore, further description is negligible.

At a position between the upstream feed roller **11*a* and the printing section 15, a second sheet detector 29 is provided. The second detector 29 is constituted by a conventional photosensor similar to the first detector 27 so as to detect the sheet fed by the upstream feed roller 11*a***.

A sheet discharge roller 23 is provided at the downstream side of the downstream feed roller **11*b*, and a pair of guide plates 21 are disposed between the downstream feed roller 11*b* and the discharge roller 23. Further, a discharge tray 24 is provided at immediate the downstream of the discharge roller 23. The sheet on which the image is printed is directed toward the discharge roller 23 through the guide plates 21. By rotation of the discharge roller 23, the sheet is discharged into a predetermined direction as indicated by an arrow C in FIG. 1 and is discharged onto the discharge tray 24**.

Incidentally, the manual feed roller 6 constitutes a first roller, and the upstream feed roller **11*a*** constitutes a second roller in accordance with the present invention.

Figure 2:
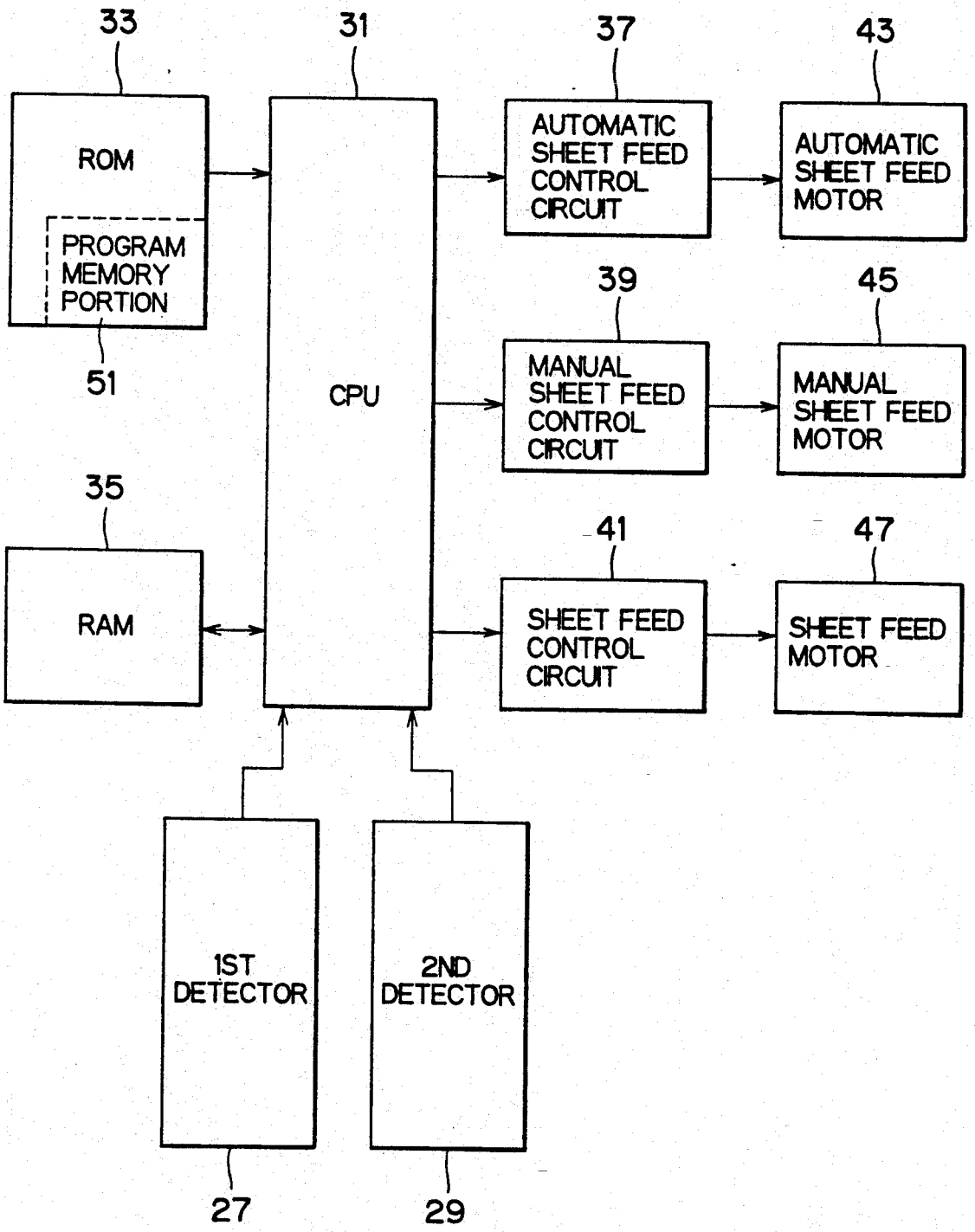
FIG. 2 is a block diagram showing a control means which control sheet feeding operation according to the embodiment of this invention.

Next, the arrangement of a control means for executing the sheet feed control will be described with reference to FIG. 2. A ROM 33 and a RAM 35 are connected to a CPU 31. Further, to the CPU 31, are connected the automatic sheet feed motor 43, the manual sheet feed motor 45 and the sheet feed motor 47, through an automatic sheet feed control circuit 37, a manual feed control circuit 39 and a sheet feed control circuit 41. Moreover, the above described first and second sheet detectors 27 and 29 are also connected to the CPU 31.

The automatic sheet feed motor 43 is adapted for drivingly rotating the automatic sheet feed roller 5, and the manual sheet feed motor 45 is adapted for drivingly rotating the manual sheet feed roller 6 by way of respective gear trains (not shown). The sheet feed motor 47 is adapted for rotating the upstream and downstream feed rollers **11*a* and 11*b*** by way of a timing pulley and a timing belt (not shown).

Figure 3:
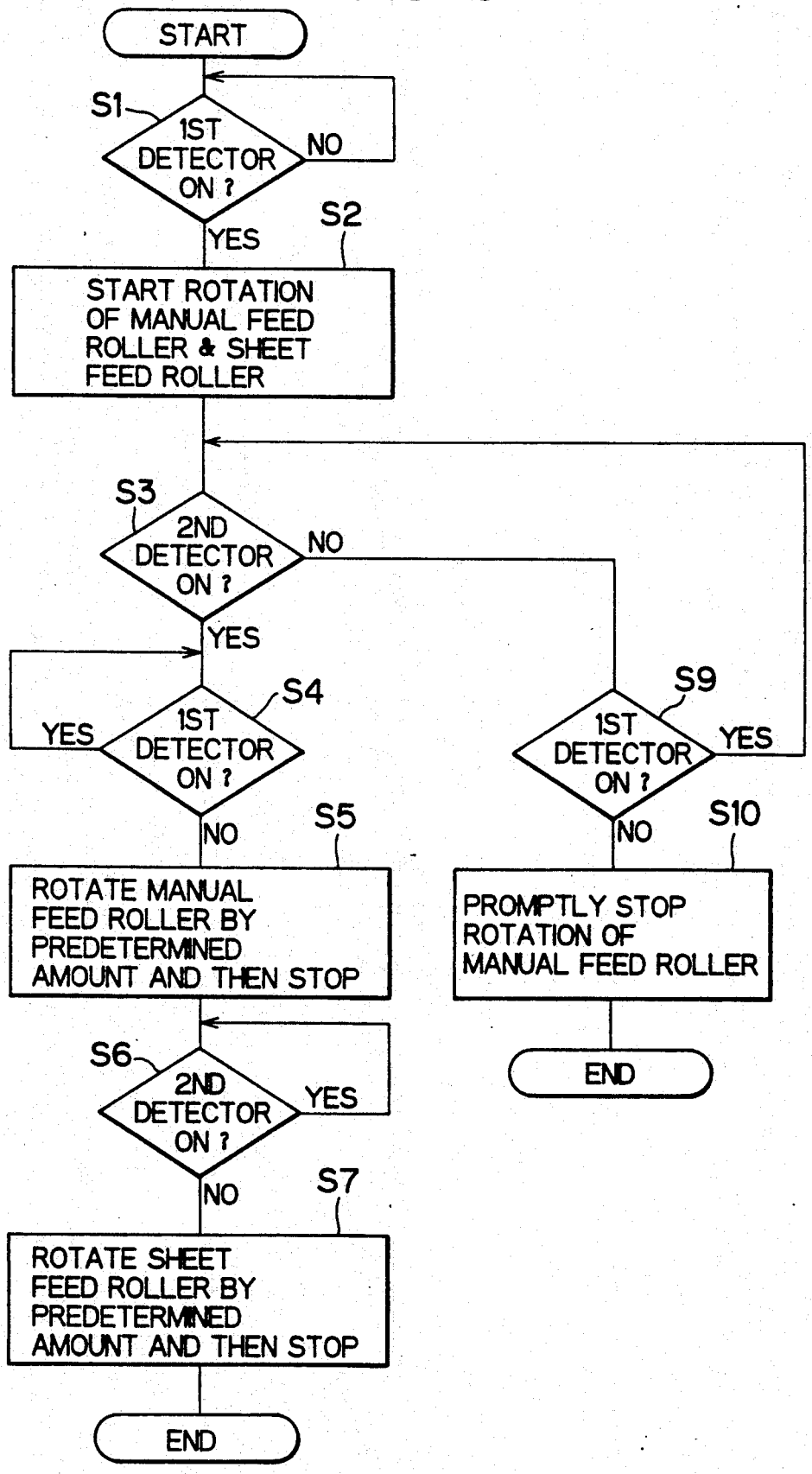
FIG. 3 is a flow chart showing a sheet feed operation routine in a manual sheet supply according to the embodiment.

In the ROM 33, a control program represented by a flowchart shown in FIG. 3 is stored. The ROM 33 has a program memory portion 51 in which is stored a control pro gram for controlling overall operation of the printer 1. Incidentally, a combination of the CPU 31, the ROM 33 the manual sheet feed control circuit 39 and the manual sheet feed motor 45 constitutes a drive control means in accordance with the present invention.

A sheet feed operation in the manual sheet supply will described with reference to a flowchart shown in FIG. 3.

First, in Step S1, if a leading end of the sheet B manually inserted through the manual insertion slot 4 by the operator is detected by the first sheet detector 27, that is, if the sheet non-detection state is changed to sheet detection state in the first sheet detector 27 (S1:Yes), the routine proceeds into Step S2. Therefore, the manual sheet feed roller 6, and the upstream and the downstream feed rollers **11*a* and 11*b* are rotated in the sheet feed direction (clockwise direction in FIG. 1). By the rotation of these rollers, the sheet B manually inserted through the manual insertion slot 4 is fed toward the printing section 15**.

Next, the routine goes into Step S3, where judgment is made as to whether or not the second sheet detector 29 detects a leading end of the sheet B. If the leading edge of the sheet B is detected by the second sheet detector 29, that is, if the non detection state is changed to the detection state in the second sheet detector 29 (S3:Yes), the routine proceeds into Step S4. In the Step S4, judgment is made as to whether or not the first sheet detector 27 still detects the sheet B. The Step S4 is repeatedly carried out until the first detector 27 does not any more detect the sheet B.

If the first sheet detector 27 does not detects the sheet B, (S4: NO), the routine goes into Step S5 where the manual feed roller 6 is rotated by a predetermined angular amount and is then stopped. Meanwhile, the sheet B is fed by the upstream feed roller **11*a***, upstream pinch roller 13*a*, downstream feed roller 11*b* and downstream pinch roller 13*b* for undergoing printing by the print head 17.

Then, the routine goes into Step S6 where judgment is made as to whether or not the second sheet detector 29 detects the sheet B. If the second detector 29 does not detect the sheet B (S6:NO), the routine runs into Step S7 so that the upstream and downstream feed rollers 11*a* and 11*b* are rotated by predetermined angular amount, and are then stopped for terminating the sheet feeding operation. In this case, the sheet B is discharged onto the discharge tray 24 by the rotation of the discharge roller 23.

On the other hand, in the Step S3, if the leading end of the sheet B is not detected by the second sheet detector 29 (S3: NO), the routine proceeds into Step S9 where judgment is made as to whether or not the first detector 27 detects the sheet B. If the first detector 27 detects the sheet B (S9:YES), the routine is returned back to the Step S3. On the other hand, if the first detector 27 does not detect the sheet B, the routine proceeds into Step S10 where rotation of the manual sheet feed roller 6 is promptly stopped for terminating the sheet feed operation. Then, CPU 31 will output operation signal to a display or a buzzer (not shown) for the purpose of alarming so as to notify the temporary stop of the sheet feed operation to the operator.

Figure 4A:
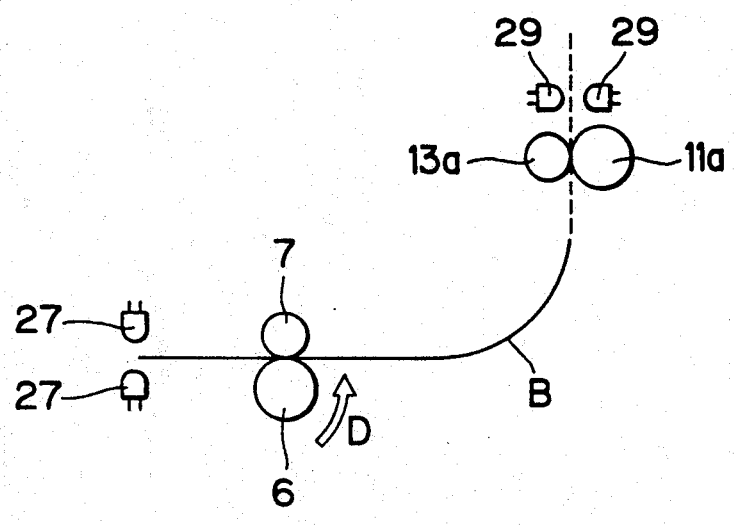
FIG. 4 (*a*) is a schematic side view showing a sheet feed mode in a manual sheet supply.
Figure 4B:
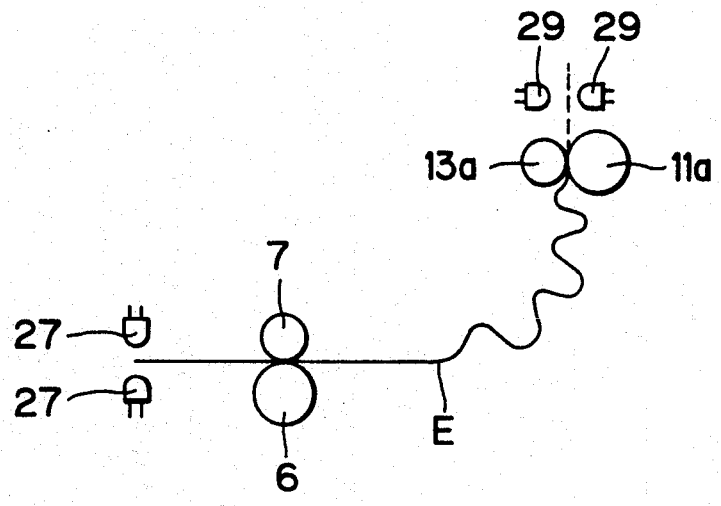

In this connection, as shown in FIG. 4(*a*), a distance between the first sheet detector 27 and the manual feed roller 6 should provide a sufficient length so as to still nip the trailing end portion of the sheet B by the manual sheet feed roller 6 and the pinch roller 7 after non detection of the sheet by the first sheet detector 27. With this arrangement, even if the sheet B whose length is smaller than a predetermined length is manually inserted into the insertion slot 4, the trailing edge portion of the sheet B is nipped by these rollers 6 and 7 prior to the detection of the leading edge of the sheet B by the second sheet feed detector 29 and after non-detection of the trailing edge by the first detector 27. The manual feed roller 6 is promptly stopped if the first detector 27 does not any more detect the trailing end. In this instance, the sheet B is not completely entered into the sheet feed path defined by the guide plate 9*b*, but the trailing end portion of the sheet B is still positioned upstream of the manual feed roller 6. Therefore, the sheet B can be easily removed by removing the sheet cassette 3, the removal of the cassette 3 providing the large open space for facilitating access to these rollers 6 and 7. It goes without saying that the present invention is not available for a sheet having a length smaller than the distance between the first detector 27 and the manual feed roller 6.

Further, in addition to the employment of the sheet B whose length is smaller than the predetermined length, the device is also available for an elongated sheet E as shown in FIG. 4(*b*). For example, even if such sheet E is corrugated or meandered due to any reason between the manual feed roller 6 and the upstream feed roller 11*a*, and sheet jamming occurs within the sheet feed path defined by the guide plate 9*b*, the rotation of the manual feed roller 6 can be stopped while the trailing end portion of the sheet can be still positioned upstream of the manual feed roller 6. Therefore, the sheet B can also be removed by the above described manner.

Figure 5:
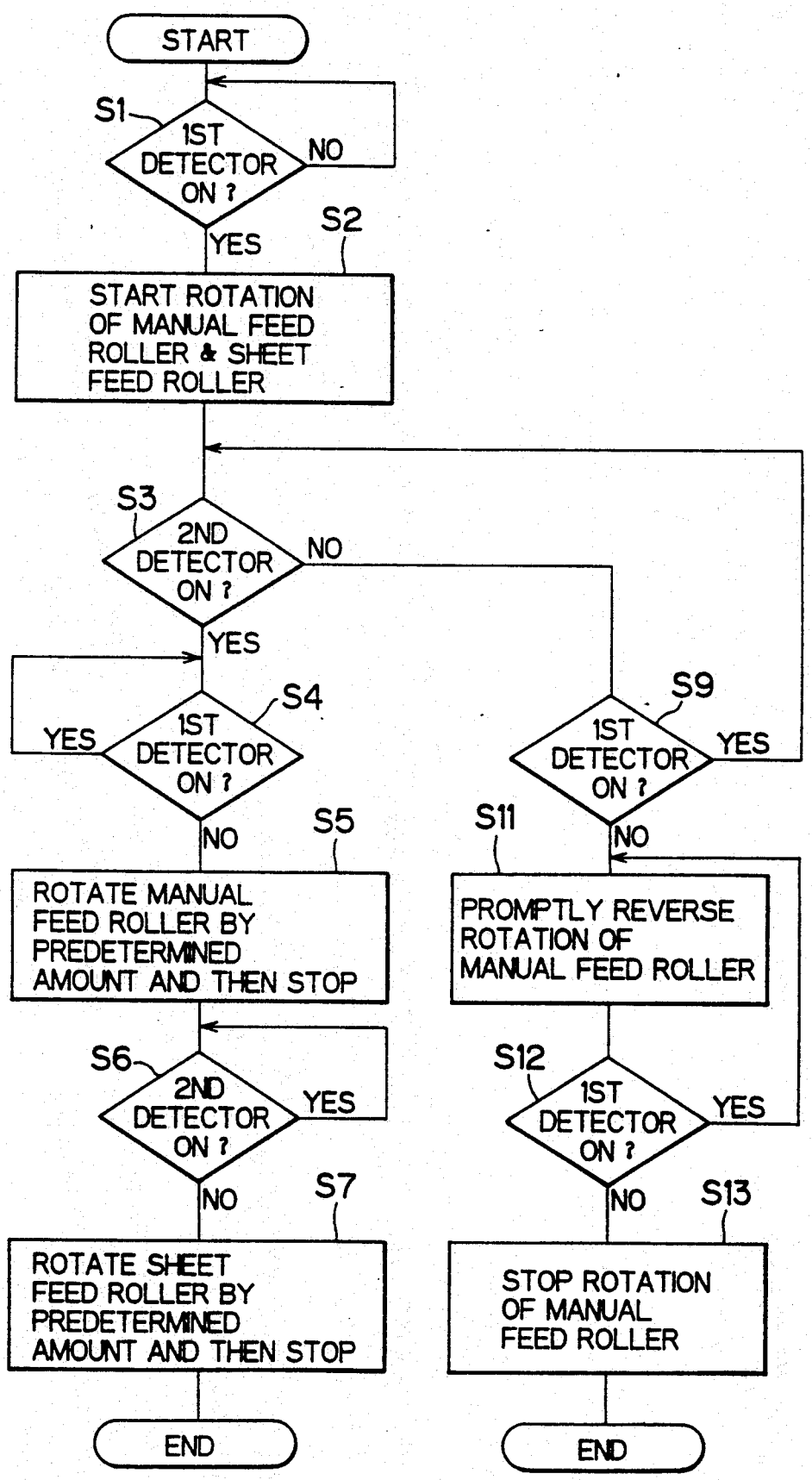
FIG. 5 is a flow chart showing a sheet feed operation routine in a manual sheet supply according to one modification of the present invention.

FIG. 5 shows another example of a control routine. In this modification, instead of the Step S10 shown in the flowchart of FIG. 3 Steps S11 through S13 shown in FIG. 5 are executed. That is, if the judgment in the Step S9 falls NO, the routine goes into the Step S11 where the rotational direction of the manual feed roller 6 is reversed, that is, the direction is changed from a clockwise direction to a counterclockwise direction in FIG. 1. Then, in Step S12, judgment is made as to whether or not the trailing edge of the sheet B is detected by the first sheet detector 27 during the reversal rotation period of the manual feed roller 6. If the sheet B is detected (S12:YES), the routine goes back to the Step S11. If the sheet is not detected (S12:NO), the routine proceeds into Step S13 for stopping rotation of the manual feed roller 6 to end the control operation.

Accordingly, since the manual feed roller 6 is rotated in a direction reverse to the sheet feed direction (in a direction indicated by an arrow D in FIG. 4(*a*)), the sheet B can be returned back to the upstream side of the manual feed roller 6. Thus, the sheet can be easily removed without detachment of the sheet cassette 3.

As described above in the sheet feed device according to the present invention, it is possible to stop the feeding operation for the sheet having a short length in capable of feeding or the sheet which is jammed at the sheet feed path due to any reason prior to the complete insertion of such sheet into the sheet feed path because of the provision of the first and second sheet feed detectors. Therefore, intricate sheet removing work is avoidable with enhanced handleablity and simple construction. That is, the sheet feeding operation is temporarily stopped or the sheet is reversally fed if the trailing end of the sheet has just moved past the first sheet detector while the leading end of the sheet has not yet been detected by the second sheet detector.

While the invention has been described in detail and with reference to specific embodiments thereof, it would be apparent to those skilled in the art that various changes and modifications may be made therein without departing from the spirit and scope of the invention.

What is claimed is:

1. A sheet feed device for feeding a sheet along a sheet feed path, the sheet having a leading edge and a trailing edge, the sheet feed device comprising:

a first roller disposed at an upstream portion of the sheet feed path relative to a sheet feed direction for feeding a sheet, the first roller being rotatable in one direction for feeding the sheet in the sheet feed direction;

a second roller disposed downstream of the first roller for feeding the sheet fed by the first roller toward an intended section;

a first detector disposed upstream of the first roller for detecting the sheet, the first detector generating a first detection signal when the sheet is moved therealong, the first detector being spaced from the first roller;

a second detector disposed downstream of the second roller for detecting the sheet, the second detector generating a signal when the sheet is moved therealong, a distance between the first and second detectors being smaller than a length of the sheet; and a drive control means for stopping rotation of the first roller, if the second detector does not detect the leading edge of the sheet even if detection of the trailing edge by the first detector has been ended.

2. The sheet feed device as claimed in claim 1, wherein the drive control means comprises;

a first motor for drivingly rotating the first roller a control circuit connected to the first motor for controlling rotation of the first roller; and a control means connected to the control circuit, the first and second detectors and the control circuit being connected to the control means, the first and second signals being transmittable from the first and second detectors to the control means.

3. The sheet feed device as claimed in claim 2, wherein the control means comprises:

means for judging arrival of the leading edge to the second detector in response to the second signal;

means for judging departure of the trailing edge from the first detector in response to non supply of the first signal;

means for stopping the first motor when the trailing edge has moved past the first detector while the leading edge has not yet been arrived to the second detector.

4. The sheet feed device as claimed in claim 3, wherein the first and second detectors comprise photosensors.

5. The sheet feed device as claimed in claim 1, wherein the drive control means further comprises means for reversely rotating the first roller.

6. The sheet feed device as claimed in claim 5, wherein the drive control means comprises;

a first motor for drivingly rotating the first roller in both directions;

a control circuit connected to the first motor for controlling rotation of the first roller; and a control means connected to the control circuit, the first and second detectors and the control circuit being connected to the control means, and the first and second signals being transmittable from the first and second detectors to the control means.

7. The sheet feed device as claimed in claim 6, wherein the control means comprises:

means for judging arrival of the leading edge to the second detector in response to the second signal;

means for judging departure of the trailing edge from the first detector in response to non supply of the first signal;

means for stopping the first motor and reversely rotating the first motor when the trailing edge has moved past the first detector while the leading edge has not yet been arrived to the second detector.

8. The sheet feed device as claimed in claim 7, wherein the control means further comprises means for stopping rotation of the first motor in response to the first detection signal after the reversal movement of the sheet.

9. The sheet feed device as claimed in claim 8, wherein the first and second detectors comprise photosensors.

* * * * *